United States Patent [19]

McFee

[11] 4,444,024

[45] Apr. 24, 1984

[54] DUAL OPEN CYCLE HEAT PUMP AND ENGINE

[76] Inventor: Richard McFee, R.D. #1, Union Springs, N.Y. 13160

[21] Appl. No.: 462,031

[22] Filed: Jan. 28, 1983

Related U.S. Application Data

[60] Division of Ser. No. 290,101, Aug. 4, 1981, Pat. No. 4,402,193, which is a continuation of Ser. No. 146,600, May 5, 1980, Pat. No. 4,326,388.

[51] Int. Cl.[3] ..... F25D 9/00

[52] U.S. Cl. ..... 62/401

[58] Field of Search ..... 62/6, 88, 401, 402, 62/403, 116, 117, 501, 510; 165/62, 4, 7, 10; 60/517

[56] References Cited

U.S. PATENT DOCUMENTS

| | | | |
|---|---|---|---|
| Re. 30,630 | 6/1981 | Morse et al. | 62/510 X |
| 2,044,330 | 6/1936 | Richter | 62/403 X |
| 3,241,327 | 3/1966 | La Fleur | 62/402 X |
| 3,321,930 | 5/1967 | La Fleur | 62/402 X |
| 3,327,495 | 6/1967 | Ergenc | 62/401 |
| 3,355,903 | 12/1967 | La Fleur | 62/88 |
| 3,763,663 | 10/1973 | Schlichtig | 62/116 X |
| 4,246,759 | 1/1981 | Signoret | 62/402 X |
| 4,295,518 | 10/1981 | Rannenberg | 62/401 X |

*Primary Examiner*—Lloyd L. King

*Attorney, Agent, or Firm*—Kenyon & Kenyon

[57] ABSTRACT

The heat pump/engine operates in an open cycle between a cold air reservoir and a hot air reservoir to pump heat or to obtain energy by exchanging air at atmospheric pressure between the two reservoirs at different temperatures.

The heat pump/engine employs a positive displacement compressor, heat exchanger and a positive displacement expander to transfer the air flows. A means is also provided for adjusting the stroke volume of the expander during expansion in the heat pump version. Also, a snowmaker preheater can be used with the heat pump to decrease power consumption.

7 Claims, 6 Drawing Figures

Dual Open Cycle Engine

Dual Open Cycle Heat Pump

DUAL OPEN CYCLE HEAT PUMP AND ENGINE

This is a division of of application Ser. No. 290,101 filed Aug. 4, 1981, now U.S. Pat. No. 4,402,193, which is a continuation of application Ser. No. 146,600 filed May 5, 1980 now U.S. Pat. No. 4,326,388.

This invention relates to a dual open cycle heat pump and a dual open cycle engine. More particularly, this invention relates to a heat pump/engine whcih operates between two masses of fresh air at atmospheric pressure and at different temperatures while using the air as a working medium.

As is known, various types of thermal machines have been used to convert temperature differences into mechanical energy, e.g., engines, or vice versa, e.g. heat pumps. For example, the known Freon type heat pumps generally accept heat at an evaporator through which air is blown (and chilled) and reject heat at a condenser through which air is also blown (and heated). However, the work required to transfer a given amount of heat with these devices is of the order of 3 to 10 times the theoretical minimum. This poor performance is due in large part to the relatively large temperature differences (e.g., 10° K.) which exist between the Freon in the heat exchangers and the air circulating through them.

It is well known that buildings heated or cooled by heat pumps must be properly sealed so as to prevent infiltrating air from reducing the temperature difference which the heat pump is striving to create. At the same time, it is desirable to have at least one air change per hour in residences and 2 to 20 air changes per hour in office buildings, schools, stores, theatres, and factories in order to flush out objectionable odors and to prevent the build-up of poisonous gases. The latter include carbon monoxide from stoves, carbon tet from clearning operations, formaldehyde vapor from foam insulation, mercury vapor from spilled mercury, and the like. In well sealed homes and buildings, explicit ventilation systems are usually installed. These units often include means to exchange heat between incoming and outgoing air streams so as to reduce the load on the heating-/cooling system caused by the ventilation. These exchangers generally reduce the extra thermal load caused by the explicity ventilation to about half what the load would be without the exchanger. Even so, the load is substantial and the cost of the load as well as the cost of the ventilating equipment with exchangers is not small.

It is also known to use solar collectors as sources of heat energy. In the most inexpensive and reliable units of this type, heat is usually carried away from a number of heat collector units by circulating air at atmospheric pressure through the collectors. However, even with air type solar collectors having a modest focusing ability, the temperature of the hot air is only of the order of 400° K. If the heat collected is used to operate an engine with an ambient temperature of 300° K., the maximum (Carnot) efficiency is (400–300) / 400 or 25%. Largely because of substantial temperature differences in the evaporator and condenser, efficiencies obtainable with Freon type engines (as well as in engines using ammonia, propane, and the like) are of the order of one quarter of this maximum, i.e. 6%.

The dual open cycle heat pump/engine is closely related to, but not identical to the regenerative Brayton cycle. Many texts on heat machines discuss the Brayton cycle (e.g. chapters 11 and 17 in "Basic Thermodynamics", B. Skrotski, McGray-Hill, 1963). This cycle consists of an adiabatic compression followed by a constant pressure heating, an adiabatic expansion and then a constant pressure cooling, accomplished in closed cycle Brayton machines by a gas circulating around a loop consisting of a compressor, heater, expander and cooler. In simple open cycle Brayton engines ("jet engines"), the gas is air and the entire atmosphere is used as a cooler and, heating is done in a pressurized combustor into which fuel is injected and burned. However, stationary forms of the simple Brayton cycle do not have good efficiency and are not usually seen in commercial equipment. A Brayton engine is described in U.S. Pat. No. 4,077,221. A Brayton heat pump using a radial arrangement of compressors and expanders is described in U.S. Pat. Nos. 2,310,520 and 2,328,439.

Simple Brayton type engines feature circulating flow through a compressor, heater, expander, and cooler. Efficiency can be much improved by employing a low pressure ratio and by using the heat in the hot exhaust of the expander to warm the gas issuing from the compressor prior to entry of the gas into the heater. This requires an extra heat exchanger (regenerator or recouperator). This "regenerative Brayton" type of engine is used, in open cycle gas turbine form, to produce electric power and may soon be widely used as a prime mover for vehicles and boats, as is discussed in "ERDA Automotive GAS Turbine Program", C.S. Chen, p. 10 of the 1977 proceedings of the International Energy Conversion Engineering Conference (IECEC). In these engines, the gas in the heater (combustor) is pressurized.

Accordingly, it is an object of the invention to provide a heat pump which approaches the maximum (Carnot) efficiency more closely than Freon type heat pumps.

It is another object of the invention to reduce the cost of heat pump operation and to conserve energy.

It is another object of the invention to provide a heat pump which ventilates automatically in the process of operation.

It is another object of the invention to provide a heat pump which does not require auxiliary ventilating equipment.

It is another object of the invention to provide a heat pump/engine which is capable of efficiencies of roughly half of the theoretical maximum.

It is another object of the invention to provide an engine capable of producing power at exceptionally high efficiency using a supply of hot air at atmospheric pressure.

Briefly, the invention provides a dual open cycle engine which operates between a cold air reservoir storing cold air and a hot air reservoir storing air at a temperature greater than the temperature in the cold air reservoir and at a pressure equal to the cold air in the cold air reservoir. The engine includes a positive displacement compressor, a heat exchanger and a positive displacement expander.

The compressor, for example, a reciprocating compressor or a rotating vane-type compressor, is connected to the cold air reservoir in order to receive and compress a flow of air therefrom.

The heat exchanger is composed of a pair of countercurrent flow paths wherein one flow path is connected to the compressor to receive a flow of compressed air while the other flow path is connected to and between the reservoirs to conduct a flow of hot air from the hot air reservoir to the cold air reservoir in heat exchange relation with a flow of compressed air in the first flow path.

The expander, for example, a reciprocating expander or a rotating vane-type expander, is connected to and between the first path of the heat exchanger and the hot air reservoir in order to expand and deliver a flow of expanded air from the heat exchanger to the hot air reservoir.

The engine may also have a common shaft on which the compressor and expander are mounted. This shaft may also be used for extracting work.

During operation, air from the cold air reservoir is compressed in the compressor, then passed through the heat exchanger and then expanded in the expander back to the original pressure. Thereafter, the air is discharged into the hot air reservoir. At the same time, an equal mass of air from the hot air reservoir is passed through the heat exchanger without compression or expansion to the cold air reservoir in a heat exchange relation.

The invention also provides a dual open cycle heat pump which operates between a cold air reservoir and a hot air reservoir as above and includes a heat exchanger, compressor and expander. In this case, the heat exchanger has a pair of counter-current flow paths with one flow path connected between the reservoirs to conduct a flow of air from the cold air reservoir to the hot air reservoir. The compressor is connected between the hot air reservoir and the second flow path of the heat exchanger to compress and deliver a flow of hot air from the hot air reservoir to the second flow path and the expander is connected between the second flow path of the heat exchanger and the cold air reservoir in order to expand and deliver a flow of expanded air from the heat exchanger to the cold air reservoir.

The heat pump also includes a motor for driving the compressor and the compressor and expander may be mounted on a common shaft.

During operation as a heat pump, heat can be transferred in similar manner between a mass of air outside a building (i.e. a cold air reservoir) and a mass of air inside the building (i.e. a hot air reservoir) without the need for bulky and expensive evaporators and condensers as is otherwise required by conventional Freon type heat pumps. Further, the heat pump simultaneously provides ventilation.

As an engine, operation can occur between an air mass at ambient temperature and a mass of hot air (for example at a modestly high temperature) provided by air type solar collectors. In both cases, overall efficiency is exceptionally high because temperature drops as would occur in evaporators and condensers are avoided.

It is to be noted that the term "dual open cycle" is used to define the heat pump/engine since each operates with an open cycle at both ends.

Whereas in an open cycle gas turbine, the cooler is absent; in a dual open cycle engine, both the heater and cooler are absent. There is not combustor. The hot air reservoir serves as a heater and the engine configuration is chosen so that the pressure in this reservoir is the same as that in the low temperature reservoir. Temperature drops in heat exchangers are eliminated. With positive displacement compressors and expanders, very high efficiencies can be attained, not only in the engine, but also in the dual open cycle heat pump, which is the engine run backwards.

The heat pump/engine can be constructed with various supplemental features. For example, the heat pump/engine can be provided with a means to prevent fumes from lubricating oil from entering the air passing through the heat pump/engine. Also a suitable means may be provided for adjusting the stroke volume of an expander used in the heat pump in order to insure that the power recovered from the expander is maximum. Still further, a "snowmaker preheater" can be used to prewarm very cold outside air prior to use. Finally, the heat exchanger of the equipment can be used to provide ventilation with little energy loss at times when the heat pump is not operating.

These and other objects and advantages of the invention will become more apparent from the following detailed description and appended claims taken in conjunction with the accompanying drawings in which:

Figure 4:
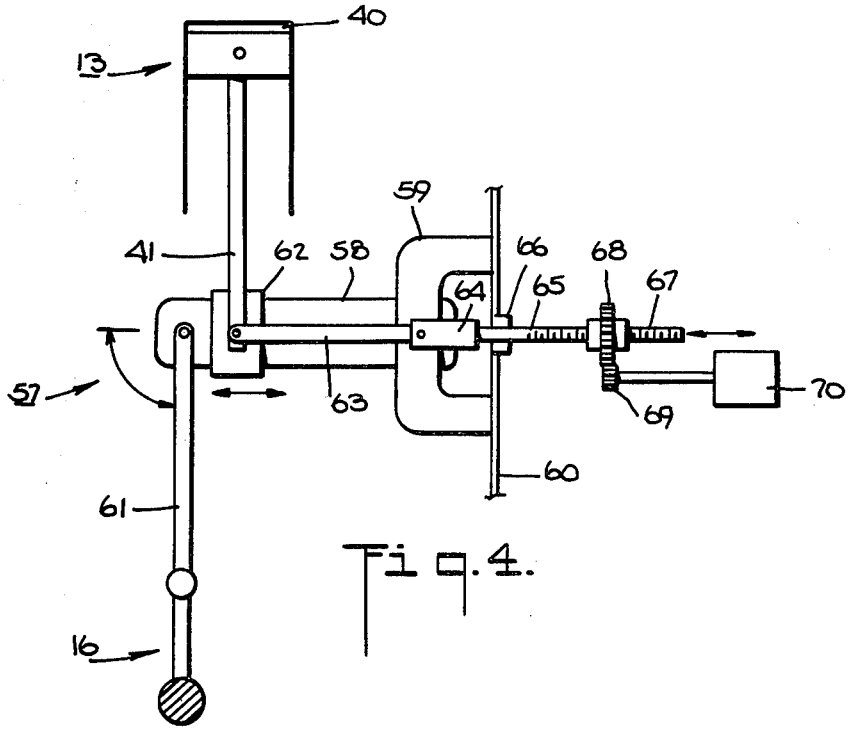
Figure 3:
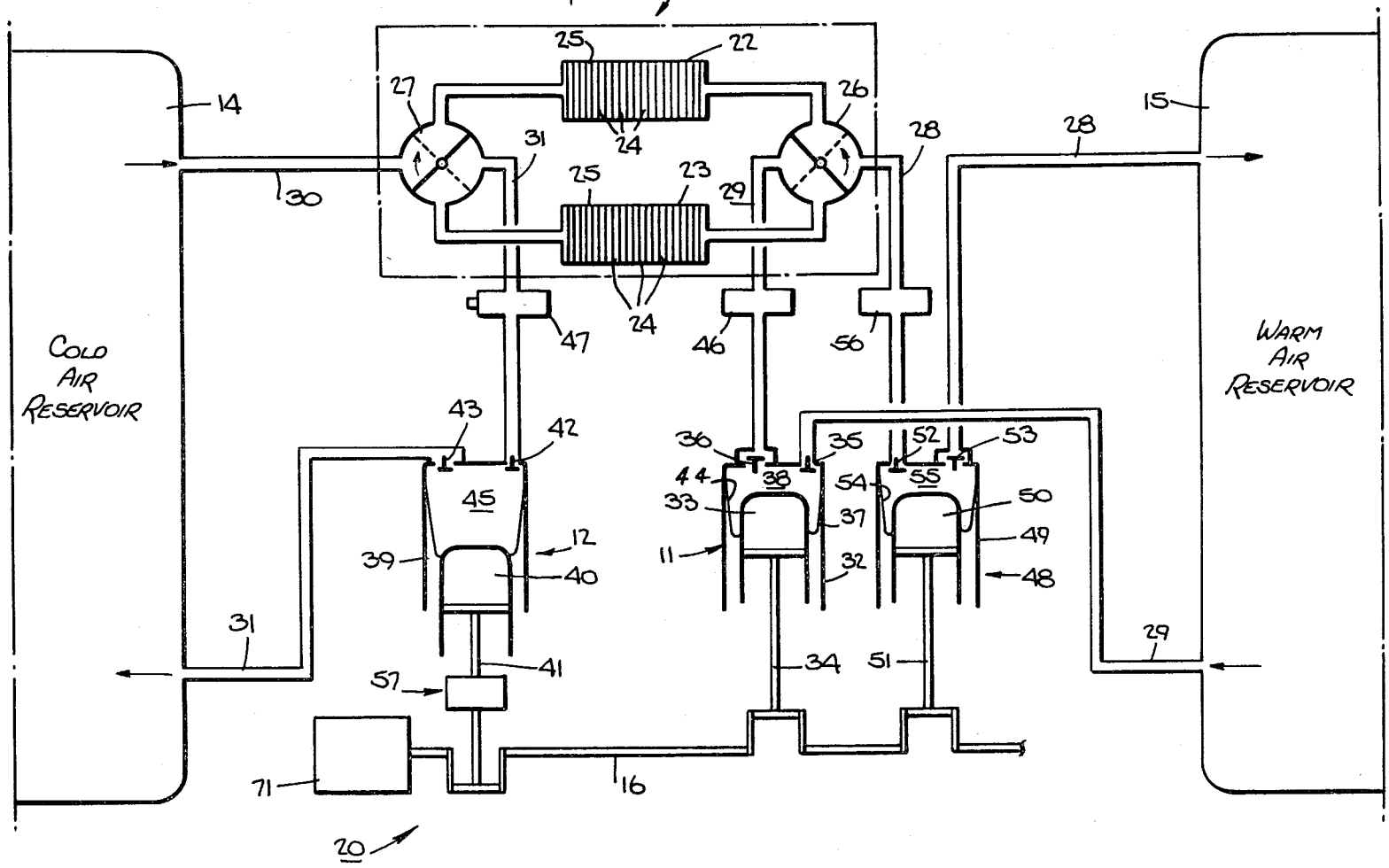

FIG. 3 diagramatically illustrates a modified heat pump constructed in accordance with the invention;

FIG. 4 illustrates a view of a means for adjusting the stroke of an expander of a heat pump constructed in accordance with the invention.

Figure 5:
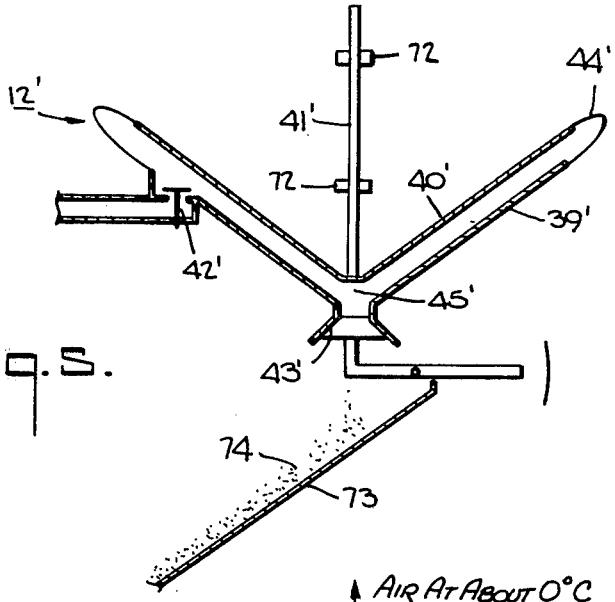
Figure 6:
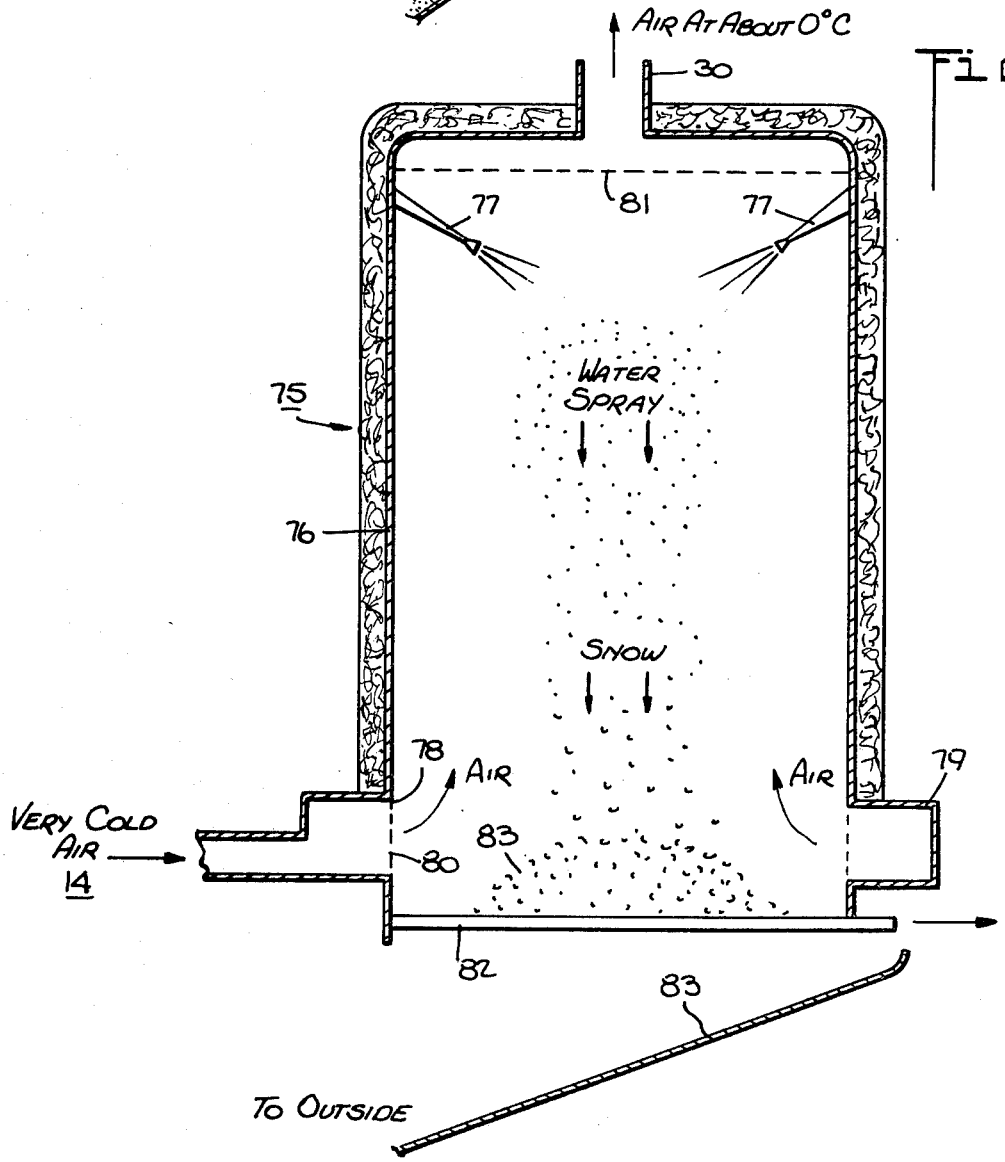

FIG. 5 illustrates a modified expander for a cold climate heat pump in accordance with the invention; and FIG. 6 illustrates a snowmaker preheater utilized by a heat pump/engine according to the invention.

Figure 1:
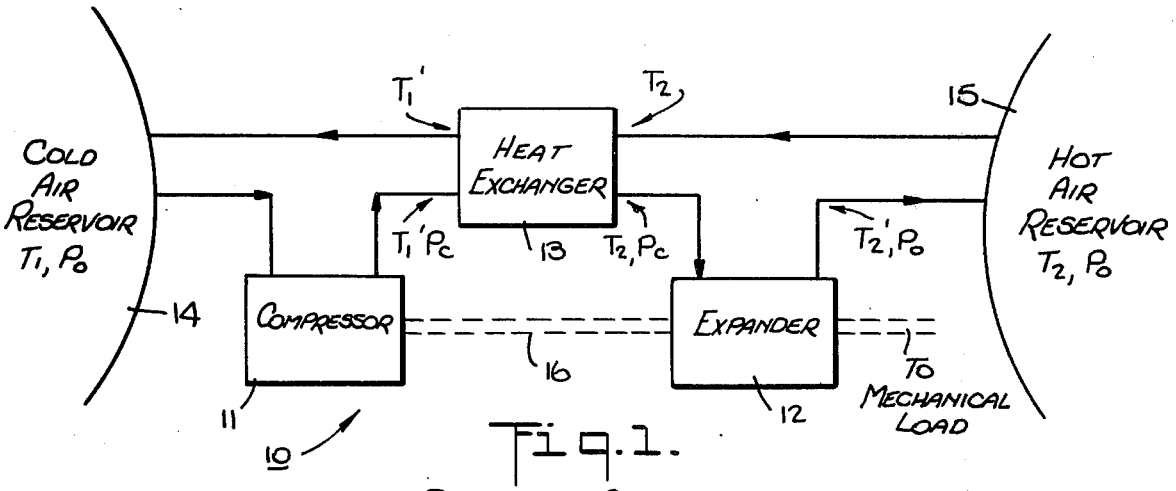
FIG. 1 illustrates a block diagram of a dual open cycle engine constructed in accordance with the invention.

Referring to FIG. 1, the dual open cycle engine 10 consists of three parts: a compressor 11, an expander 12, and a counterflow heat exchanger (recouperator or regenerator) 13. There are two basic differences between the engine and a regenerative Brayton engine. First, the engine has no combustor as a "hot space" filled with hot fresh air replaces the combustor. Second, the air is expanded prior to entry into the hot space rather than after passage through a combustor. This leads to a greater temperature difference across the heat exchanger 13, thus requiring a larger heat exchanger having a greater pressure drop. However, this is tolerated because the engine 10 is operated between hot and cold spaces in which the pressures are the same. Thus, a heat pump version of the machine can be operated open cycle at both ends ("dual open cycle") so that heat can be transferred directly between the air outside a building and that inside without the need of evaporators, condensers, or comparable structures.

Although, use is required of a counterflow heat exchanger 13, the exchanger 13 may be a regenerator in which a matrix supplies a very large heat exchange area in a compact low cost unit so that, in operation, temperature differences within the matrix are small and heat exchange almost ideal.

In discussing the principle of operation of the invention, it is convenient to assume as a first approximation that the heat exchanger 13 is perfect, such that the gas issuing from the hot end has the same temperature as that entering that end, and the same is true of the cold end.

In the engine in Fig. 1, air taken from a cold gas reservoir 14 is first compressed in the compressor 11 and thereby heated slightly from $T_1$ to $T_{1'}$. The air is then passed through the heat exchanger 13 and emerges with the temperature of the air entering the hot end of that exchanger 13, namely $T_2$. Next, the air is expanded in the expander 12 to a temperature $T_{2'}$ slightly lower than $T_2$ and discharged into a hot air reservoir 15 where the air is heated up to $T_2$. An equal amount of air from the hot air reservoir 15 is made to flow through the heat exchanger 13 in the reverse (hot or cold) direction, emerging from the heat exchanger 13 with the temperature of the air entering the cold end, namely, $T_{1'}$. The expander 12 and compressor 11 operate between the same two pressures. However, because the air in the expander 12 is hotter, the volume of the air and its work are also greater. Thus, with ideal expanders 12 and compressors 11, net work is available.

As illustrated, the compressor 11 and expander 12 can be mounted on a common shaft 16 which connects to a mechanical load (not shown) so as to permit the extraction of work.

Referring to FIG. 3, wherein like reference characters indicate like parts as above, the heat pump 17 operates such that air from the hot air reservoir 15 is first compressed in the compressor 11 then passed through the heat exchanger 13 in the reverse (cold to hot) direction. This flow sets the temperature of the hot end of the heat exchanger 13 to $T_{2'}$. The air from the hot reservoir 15 emerges from the heat exchanger 13 at temperature $T_1$ and is then expanded, dropping to $T_{1'}$. After discharge into the cold reservoir 14, the air heats up to $T_1$. The hot end of the heat exchanger 13 is at $T_{2'}$ which is greater than $T_2$ because of the compression. Air going through the exchanger 13 from the cold end to the hot end emerges at this temperature and cools down to $T_2$ after discharge. Thus, the hot reservoir 15 is heated, the cold reservoir 14 cooled, and heat pumped from cold to hot.

Figure 2:
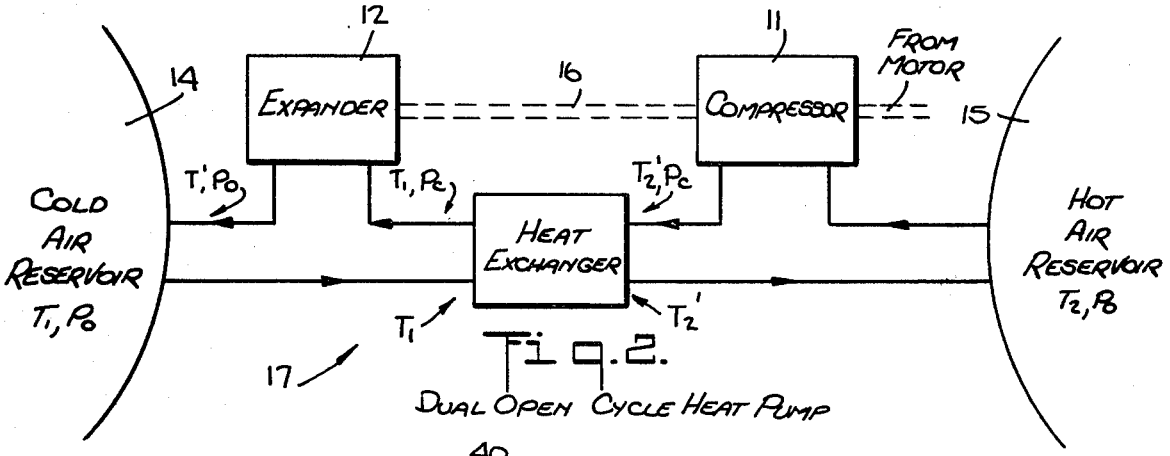
FIG. 2 illustrates a block diagram of a dual open cycle heat pump constructed in accordance with the invention.

In both the engine in FIG. 1 and the heat pump in FIG. 2, the air is compressed before passing through the heat exchanger 13. However, an alternative arrangement (not shown) is possible, the air being expanded to a sub-atmospheric pressure prior to passage through the heat exchanger. In this case, the expander is on the hot side in the engine and on the cold side in the heat pump, as before. A disadvantage of these variants is that the volume of the air expanded and compressed is larger than in the illustrated arrangements.

In order to estimate the performance of the engine it is assumed initially that the heat exchanger 13 is ideal and that the air obeys the equation $PV=n\,RT$. It is also assumed that the specific heats $c_p$ and $c_v$ are constant and hence their ratio $k=(c_p/c_v)$ is also constant. The pressure in the reservoirs is $P_o$ and the pressure after compression is $P_c$. Let $(k-1)/k=b$. Using the standard equations for adiabatic expansion or compression of a gas, the relationships for the engine of FIG 1 are:

$$(T_2/T_2')=(P_c/P_o)^b \text{ and } (T_1'/T_1)=(P_c/P_o)^b$$

The heat $H_2$ absorbed in the hot reservoir 15 is $c_p(T_2-T_2')$ while the heat $H_1$ rejected to the cold reservoir 14 is $c_p(T_1'-T_1)$. The net work X per unit mass of air which circulates is $(H_2-H_1)$. Thus, the efficiency $(X/H_2)$ is given by $(T_2-T_2'-T_1'+T_1)\ /\ (T_2-T_2')$. Since $(T_2/T_2')=(T_1'/T_1)$, this reduces to $n_t=(T_2'-T_1)/T_2'$ where $n_t$ is $(X/H_2)$, the thermodynamic efficiency. This is exactly the same as the expression for the Carnot limit except that $T_2'$ has been substituted for $T_2$. Thus, so long as $T_2'$ is not too much smaller than $T_2$, i.e. the pressure ratio is not too great, the thermodynamic efficiency will approach the Carnot efficiency.

Although recouperators of the counterflow type can, in principle, be used, those of realistic size do not have as much surface area for heat transfer as is desirable, and regenerative exchangers with their much larger heat transfer areas are preferable. These consist typically of a stack of a large number of disks of wire screen. The temperature inside this matrix decreases continuously as one passes from the hot to the cold end. In a real (rather than ideal) unit there is a temperature difference ($\Delta T$) between air and matrix. It is this difference that propels the heat transfer. Thus, in the arrangement in FIG. 1, air emerges from the regenerator matrix at a temperature of $(T_2-2(\Delta T))$ at the hot end and $(T_1'+2(\Delta T))$ at the cold end, the hot end matrix being at a temperature $(T_2-\Delta T)$ and the cold end at a temperature of $(T_2-2(\Delta T))$ while the same amount enters the hot end at temperature $T_2$, then there will be a net loss of heat at the hot end of $2c_pM(\Delta T)$ and an equal heat gain in the cold reservoir 14. This amounts to a heat leak between the reservoirs. If the mass flow M and the temperature difference ($\Delta T$) of the regenerator are known, the heat leak is also known. The engine can be viewed as operating in an ideal fashion between reservoirs having the same temperatures as the ends of the matrix with a heat leak of this amount superimposed.

Energy is also lost in piston ring friction, internal friction in the flexible materials used for diaphragms, and friction in bearings cams and bearings. Pressure drops in valve ports, air ducts, and leakage of air by rings and seals also reduce efficiency. In the engine, these losses are conveniently dealt with in terms of overall factor $n_e$ such that the actual mechanical output of the engine X'is given by $X'=n_e(X-F)$ where F is the power needed to overcome the pressure drop in the regenerator. It will be assumed that in a well constructed engine $n_e$ is 0.8. In heat pumps, a similar equation is used with the actual mechanical input X' required being given by $X'=n_h(X+F)$ where $n_h$ for a well designed heat pump will be taken to be 1.2.

The power (watts) lost in regenerator pressure drop is $(\Delta P)V$ where $(\Delta P)$ is the pressure drop (newtons/$m^2$) and V is the volume of air ($m^3$) which passes through the regenerator per second in one way or the other.

Referring to FIG. 3, wherein like reference characters indicate like parts as above, the heat pump 20 uses a heat exchanger 21 which is in the form of a dual switched regenerator having two regenerators 22, 23. Each regenerator 22, 23 consists of a stack of many discs 24 of wire screen in a tube 25. The heat exchanger 21 is connected with the cold air reservoir 14 and hot air reservoir 15 so that the regenerators 22, 23 provide a pair of counter-current flow paths. As shown, the flow path through the regenerator 22 connects the reservoirs 14, 15 so as to conduct a flow of air from the cold air reservoir 14 to the hot air reservoir 15. The other regenerators 23 is located in the second flow path which conducts the down flow stream from the hot air reservoir 15 to the cold air reservoir 14.

The heat exchanger 21 has a pair of valve means 26, 27 for alternately connecting each of the regenerators 22, 23 to the reservoirs 14, 15 to alternately convey a flow of cold air from the cold air reservoir 14 to the hot air reservoir 15 and a flow of hot air from the hot air reservoir 15 to the cold air reservoir 14. As indicated, the hot ends of the two regenerator tubes 25 are connected via the valve means 16 to a pair of ducts 28, 29 which carry air to and from this hot end to and from the hot air reservoir 15. The connections of the ducts 28, 29 to the hot air reservoir 15 are located some distance apart so that the air cannot circulate directly from one duct 28 to the other duct 29 but rather disburses throughout the reservoir 15. The other valve means 27 is connected to the cold ends of the two regenerator tubes 25 and the cold air reservoir 14 via ducts 30, 31 in similar manner.

During operation, the positions of the valve means 26, 27 are alternated in unison every few seconds so that the downflow stream passes through the regenerator formally carrying the upflow stream and vice-versa. This change in valve position can be accomplished in any suitable manner, for example via solenoids or small fast-response electric motors with limit switches (not shown).

As shown in FIG. 3, the compressor 11 and expander 12 are of the diaphragm type. Further, the compressor 11 is connected to and between the hot air reservoir 15 and the valve means 26 by being disposed in the duct 29 so as to compress and deliver a flow of hot air to the valve means 26. The expander 12 is connected to and between the valve means 27 and the cold air reservoir 14 by being disposed in the duct 31 so as to expand and deliver a flow of expanded air from the valve means 27 to the cold air reservoir.

The compressor 11 includes a cylinder 32 and a piston having a piston head 33 reciprocally mounted in the cylinder 32 and a piston rod 34 extending from the cylinder 32 to the shaft 16 which is in the form of a crankshaft. The compressor 11 also has an inlet valve 35 in the form of a check valve for introducing hot air from the duct 29 into the cylinder 32 and an outlet valve 36 in the form of a check valve for exhausting compressed air from the cylinder 32 to the valve means 26 via the duct 29. In addition, a flexible diaphragm 37 is connected between the cylinder 32 and piston head 33 so as to define a chamber 38 into which the air can be introduced and exhausted via the valves 35, 36. This diaphragm 37 may be a rubberized fabric. The life of the diaphragm 37 of this piston-cylinder unit depends, in part, on the tension to which the diaphragm is subjected and, in part, on the minimum radius of curvature through which the diaphragm is bent and on the number of cycles. With a relatively thin lightly loaded fabric operated with a large bending curvature, between $10^8$ and $10^9$ cycles are attainable. At three cycles per second, $10^8$ cycles is a years operation and $10^9$ is ten years, for example.

By reducing the pressure of the air in the crankcase (not shown) below atmospheric with a small air pump, the thin fabric type diaphragms will be drawn downwards and will maintain proper curvature even when the compressor is sucking air in during its intake stroke.

The expander 12 is of similar construction to the compressor 11. To this end, the expander includes a cylinder 39, a piston having a piston head 40 reciprocally mounted in the cylinder 39 and a piston rod 41 extending from the cylinder 39, an inlet valve 42 for introducing air from the valve means 27 into the cylinder 39 and an outlet valve 43 for exhausting expanded air from the cylinder 39 to the cold air reservoir 14 via the duct 31. The expander 12 also has a diaphragm 44 connected between the cylinder 39 and piston head 40 to define a chamber 45 which communicates with the valves 42, 43.

The valves 42, 43, however, are cam actuated via suitable cams (not shown) for purposes as described below.

The compressor 11 and expander 12 may also be constructed in the manner of an "air spring". Also use may be made of oil supported disphragm type "rollsock" seals made of polyurethane rubber. Still further, the compressor 11 and expander 12 may use piston rings as seals. Ring friction can be greatly reduced through the use of Teflon coatings and through the use of low friction lubricants.

As shown in FIG. 3, a plenum 46, 47, respectively is disposed in each duct 29, 31 in order to avoid any energy-wasting pressure drops in the air flows. These plenums 46, 47 are of a size to have a capacity in an order of magnitude or greater than the stroke volume of the compressor 11 and expander 12. Further, the various valves 35, 36, 42, 43 should be fully opened when there is flow through the valves.

In order to insure that an equal amount of air passes through the regenerators 22, 23 in counter-current direction, an air pump 48 is disposed in the duct 28 between the valve means 26 and the hot air reservoir 15. This air pump 48 is constructed in a manner similar to the compressor 11 and is connected to the crankshaft 16. As shown, the air pump includes a cylinder 49, a piston having a head 50 and a piston rod 51, an inlet valve 52 in the form of a check valve and an outlet valve 53 in the form of a check valve. Also, a diaphragm 54 is connected between the cylinder 49 and the piston head 50 to define a chamber 55 communicating with the valves 52, 53. The piston rod 51 is connected to the crankshaft in 16 in conventional manner. Also, a plenum 56 is disposed in the duct 29 upstream of the air pump 48.

The air pump 48 has a stroke volume equal to that of the compressor 11 and operates the same number of times as the compressor 11 per minute so that the air passing through the regenerators 22, 23 per minute is exactly the same.

The reciprocating air pump 48 can be replaced by a variable speed fan or blower whose speed is adjusted by suitable feedback means (not shown) so as to make the measured air flow in both directions the same. Many devices exist for making such a measurement, for example a "hot wire" anemometer. In either case, the power consumed by the air pump 48 or blower is relatively small since the "head" which must be produced by the pump 48 or blower is small.

When the heat pump 20 is operating properly, the compressor 11 and expander 12 handle the same mass of air per second. However, the volume of air discharged in each stroke by the compressor 11 is larger than that taken in each stroke by the expander 12 since the air entering the expander is cooler. The ratio of volumes is equal to $(T_2'/T_1)$ and depends on temperature. If the expander intake volume is incorrectly set, overall heat pump efficiency is reduced. Accordingly, a means 57 for adjusting the expansion stroke of the piston of the expander 12 and thus the stroke volume of the expander 12 during the operation of the machine is provided. When the expander intake volume is correctly set, the pressure within the expander at the end of expansion is equal to that of the atmosphere. Alternatively, if the expansion pressure ratio is kept constant, the pressure at the intake of the expander should equal Pc, which is the pressure Po of the atmosphere multiplied by the pressure ratio of the expander. The pressure ratio of the expander is determined by the timing of its valves.

Referring to FIG. 4, the preferred means 57 for adjusting the stroke volume of the expander includes a lever arm 58 which is pivotally mounted at one end on a pair of lever arm brackets 59 which are fixedly mounted to a frame 60 of the heat pump, a connecting rod 61 which is pivotally mounted on an opposite end of the lever arm 58 and pivotally connected to the crankshaft 16, and a slider 62 which is slidably mounted on the lever arm 58 and pivotally connected to the piston rod 41. In addition, a means is provided for moving the slider 62 along the lever arm 58 in response to the pressure at the inlet valve 42 (see FIG. 3) of the expander 13.

The means for moving the slider includes a pair of slider control rods 63 which are pivotally mounted on one end to the slider 62 and which are pivotally mounted at the opposite end to a control rod yoke 64. The yoke 64 has a smooth shank portion 65 which passes through the frame 60 via a suitable guide 66 as shown. In addition, the yoke 64 has a threaded inner bore of a captive gear 68. The gear 68, in turn, meshes with a drive gear 69 which is driven by a reversible electric motor 70. A pressure sensor (not shown) monitors the pressure at the inlet valve 42 of the expander 13. If the pressure exceeds a predetermined value slightly higher than Pc (the given value for the plenum 47) to signify that the expander stroke volume is too small, the motor 70 is actuated to run in a direction causing the slider 62 to move towards the free end of the lever arm 58. If the pressure is at a predetermined amount slightly lower than Pc, the motor 70 is run in the opposite direction. Operation of the motor 70 is required only when there is a substantial change in temperature. For example, a small reversible induction motor can be used. Further, a similar arrangement can be used with dual open cycle engines as well as heat pumps.

It is noted that the pivot point of the lever arm 58 on the brackets 59 is located so that when the lever arm 58 is horizontal, the free end which is connected to the connecting rod 61 is moved upwardly as far as possible, as viewed.

Expander stroke volume can also be varied by control of expander valve timing.

As shown in FIG. 3, the compressor 11 and expander 12 operate only on the downflow stream and a suitable motor or engine 71 drives the crankshaft 16.

In operation, the compressor cylinder 37 takes in air during the downstroke of the piston, the inlet valve 35 closing at the end of the downstroke. The compressor piston then moves up through the compression part of the upstroke, the pressure rising to Pc at which time the outlet valve 36 opens after which the piston completes its upstroke forcing air out of the cylinder 37 in the plenum 46. In the process with the expander 12, the inlet valve 42 is opened during the first part of the downstroke, this valve 42 is then closed, and the downstroke continues expanding the enclosed air and lowering the pressure of the air simultaneously. The outlet valve 43 opens when the expander piston reaches the bottom of its stroke and remains open during the entire upstroke.

Calculations of the coefficient of performance (COP) of this heat pump can be obtained as follows. In computing the output heat $H_2$, the input work X, and the COP of heating ($H_2$/X) it will be assumed that the heat pump operates between air reservoirs 14, 15 at atmospheric pressure and temperatures of 300° K. and 275° K., that the flow rate in both directions is 10 cubic feet per second, that the volume decrease in compression is 0.9 of its initial value, and that 80% of the input mechanical energy is used in the thermodynamic process, the rest being lost in friction in actuators and the low friction diaphragm type pistons. The efficiency of the electric motor 71 driving the unit will be taken to be 85%. This motor will generally be connected to the crankshaft by means of step-down gears, and the motor armature will act as a flywheel.

The openings of the wire screens 24 of the regenerators 22, 23 are assumed to occupy a fraction "p" of the screen area (porosity) which will be taken to be 0.766. Each regenerator 22, 23 has several flow paths with the total "frontal" area of the flow paths being 8 square feet ($A_f$) and the length L of the flow path being 1 foot. The total surface area A of each regenerator 22, 23 is 4000 square feet and regenerator volume is 8 cubic feet.

It is assumed that the specific heat $c_p$ of air is 0.24 (Btu/Lb)/° F., that the ratio k of ($c_p/c_v$) is 1.4, that the viscosity $\mu$ of air is 0.05 Lb/hr-ft, and that the density $\rho$ of air is 0.08 lbs/ft$^3$. At 10 ft$^3$/sec the flow rate W in Lbs/hr is 2880.

In the adiabatic expansion and compression process, $PV^k$ and (PV/T) remain constant. If, in these processes, the initial temperature is designated T and the final temperature T', it follows that (T'/T) is equal to $(V/V')^{k-1}$ or to $(P'/P)^{(k-1)/k}$. Thus, for the compression process in the downflow stream, where $V_2'$ is assumed to be $0.9V_2$, temperature $T_2'$ will be 1.0430 $T_2$, that is 312.9° K. To regain atmospheric pressure in the expansion process, $V_1$ must be (1/0.9) $V_1$. Thus, $T_1'$ will be 0.9587, that is 263.6° K.

To estimate the $\Delta T$ and the pressure drop of the regenerator, the data compiled in the book "Compact heat exchangers" by Kays and London (2nd edition) can be used. Heat transfer characteristics of wire screen regenerators are given on page 129. The chart there shows heat conductance per unit area, h, as a function of the Reynolds number $N_R$ which is defined as $(4pGA_fL/\mu A)$ where G is $(W/pA_f)$. The units of h used here are (BtU/hr)/ft$^2$ per $^0$F. In the case considered here, G is 470 and $N_R$ is 57.6. According to the chart $(h/Gc_p)(Npr)^{2/3}$ is about 21.5 . With a difference of $\Delta T$ between the air passing through the regenerator and the adjacent matrix, the rate of heat transfer here is hA ($\Delta T$). This can be set equal to the rate of change of the heat energy in the downflow stream, i.e. to $c_pW$ $(T_2'-T_1)$. Setting these equal and solving for $\Delta T$ gives $T\text{-}c_pW(T_2'-T_1)/ha$. With values of 0.24 for $c_p$, 2880 for W, 1.8 times (313–275) for $(T_2'-T_1)$, 21.5 for h, and 4000 for A, $\Delta T$ is found to be 0.55° F.

The pressure drop in the regenerator is found from the Kays-London chart on p. 130. This chart gives the friction factor f as a function of $N_R$. The pressure drop $\Delta P$ in lbs/ft$^2$ is computed using the formula $\Delta P = f(G_s^2/2g')(A/pA_f)$; here $G_s$ is (G/3600) and g is 32.2 ft/sec$^2$. With $N_R$ equal to 58, the f according to this chart is 1.2. Thus, $\Delta P$ is 2.6 lbs/ft$^2$.

The temperature of the gas entering the hot air reservoir 14 at 300° K. is equal to 313° K. less 2($\Delta T$), i.e. 2 (o.55° F./1.8) or 0.61° K. Thus, the rise is 12.4° K. or 22.3° F. r 12,.4° K. or 22.3° F. The net heat brought in is (0.24) (2880) (22.3) or 15413 BTU/hr. At 1055 joules/BTU this is 4.52 kilowatts, enought to heat a well insulated house with an outdoor temperature of 275° K. The temperature of the gas entering the cold air reservoir at 275° K. is 263.6° K. plus 2 ($\Delta T$), i.e. plus 0.61° K. Thus, the temperature is 264.2° K. This is 10.8° K. i.e. 19.4° F. less than 275° K. Thus, the net heat gain of the cold air reservoir 14 is (0.24) (°2880) (19.4) or 13409

BTU/hr. This is 3.93 kw. Thus, the net mechanical power required by the thermodynamic cycle is (4.52–3.93) or 0.59 kw.

At 10 cubic feet per second and 2.6 lbs/ft$^2$ for $\Delta P$, each regenerator requires 26 ft-lbs/sec totaling 52 ft-lbs/sec. At 1.356 joules/ft-lb, this amounts to 0.07 kw. Added to thermodynamic power, this is 0.66kw. Under the assumption that this is 80% of the input mechanical power, that input must be (0.66/0.8) or 0.83 kw. Under the assumption that the electric motor 71 providing this power is 85% efficient, the electrical input power will be (0.83/0.85) or 0.98 kw. The coefficient of performance of the system is then given by ($H_2$/X), that is by (4.52/0.98) or 4.6. This is roughly twice the COP of a good vapor compression heat pump of standard design operating in the same temperature range.

In summary, with a temperature of 300° K. inside and 275° K. outside, the heat pump 20 supplies 4½ kilowatts of heat while consuming 1 kw of electric power. This calculation takes into account the temperature difference ($\Delta T$) as well as pressure drop of the regenerator, along with mechanical losses and losses in the electric motor. The area of the compressor piston is taken to be 2 square feet and its stroke 1½ feet, and the cycle rate is taken to be 3 per second. If all dimensions of the heat pump are doubled, the cycle rate staying the same, the power output will increase by a factor of 8 to 36 kw. Clearly, this is a large machine, but this is not a severe disadvantage in stationary applications. Compared with fossil fuel heat costing 3 cents per thermal kw-hour, this unit using electricity costing 6 cents per kw-hr, will provide thermal energy at a cost of 1.5 cents per kw-hr. The heat pump may also operate as an air conditioner. Driven by an engine rather than electricity the heat pump will have a $COP_h$ of about 5 and a $COP_c$ of about 4. Thus, a high quality heat pump is provided for use in total energy systems.

If the machine just described is operated as a "solar engine" using hot air obtained from air type solar collectors at 400° K. and a low temperature reservoir of 300° K. (the air inside the house), a similar analysis shows a net mechanical output power of 1.12 kw, and an overall efficiency (X/$H_2$) of 16.9% i.e. 68% of Carnot. In the heat pump 20, the two regenerators 22, 23 occupy 16 cubic feet of space, i.e. that of a cube 2½ on edge. If fabricated with aluminum wire screens, such a device would be quite expensive. A cheaper regenerator can be constructed with thin dimpled sheets of a suitable material, such as aluminum, galvanized steel, glass and the like; the dimples serving not only as spacers but also as means of inducing turbulence in the flow. For example, an 8 cubic foot matrix with 4000 square feet of heat exchange area can be constructed by stacking on edge, next to one another, 500 of these dimpled sheets, each four feet long and one foot high, to form a stack 2 feet wide. Sheet centers in this case are spaced by 50 thousandths of an inch, but the sheets themselves can be much thinner, e.g. 10 thousandths, The dimples can be designated to add strength to each thin sheet, as well as assuring proper spacing and promoting turbulence. Additional strength for the stack can be provided by using extra heavy material for every nth sheet, e.g. every tenth sheet.

The heat pump will operate continuously only at times of peak demand. For example, at 50% demand the machine will operate only half the time. To avoid an interuption of the ventilation provided by the machine during intervals when it is not operating, the expander valves can be held open by suitable means not shown so that Pc drops to atmospheric pressure, the compressor thereby becoming a simple air pump and the load on the electric motor being greatly reduced, while ventilation continues.

If the outside air of high humidity is cooled during passage through the regenerators 22, 23, dondensation may occur. Further, if the heat pump is used to supply heat during the winter, snow can form within the expander 12 and, in below freezing weather, within the regenerators 22, 23. Accordingly, regular defrost cycles may be used to combat the occurrence of condensation and frost as in known heat pumps. In addition, as shown in FIG. 5 wherein like reference characters indicate like parts as above, the expander 12' may be formed of a cylinder 39' of generally conical shape, a piston having a piston head 40' of generally conical shape and a diaphragm 44' which is connected to and between the cylinder 39' and piston head 40' to define a chamber 45'. The piston also has a connecting rod 41' connected, for example to a crankshaft (not shown) and guided within suitable guides 72 for reciprocating motion. This expander 12' is provided with a cam actuated inlet valve 42 and a cam actuated outlet valve 43'. As shown, the outlet valve 43' is located at the bottom of the chamber 45' for exhausting expanded air from the chamber 45'. Because of the position of the outlet valve 43', any snow which is formed in the expander 12' can be blown clear during the exhaust phase. In addition, a chute 73 is disposed below the outlet valve 43' in order to receive frost 74 from the exhaust valve 43'. The chute 73 may lead to the outside environment in any suitable manner.

Referring to FIG. 6, in very cold climates such as in Alaska, the heat pump may be capable of COP's exceeding the theoretical limit. To this end, the heat pump is provided with a "snow maker preheater" 75. This preheater 75 is constructed of a large vertically disposed tube 76 which is located between the cold air reservoir 14 and the heat exchanger (not shown) and a means, such as nozzles 77, for fine spraying water into the tube 76 at the upper end.

The tube 75 is provided with a circumferentially disposed inlet 78 at the lower end which communicates with a circumferential air duct 79 to receive a flow of cold air from the cold air reservoir 14. As indicated, a perforated screen 80 is disposed across the inlet 78. In addition, a perforated screen 81 is disposed across the upper end of the tube 76 for diffusing the flow of cold air leading to the duct 30 at the upper end of the tube 76.

During operation, cold air flows into the tube 76 via the air duct 79 and inlet 78. This air then flows relatively slowly upwardly towards the duct 30. During this time, water is sprayed into the tube 76 via the nozzles 77. The fine spray which emanates from the nozzle 77 then freezes as the spray drifts downward. At the same time, a heat exchange is effected between the water and the upward flow of cold air causing the air temperature to rise to that of freezing water, i.e. 32° F. or 273° K. Thus, if the outside air is, for example, minus 50° F., the temperature of the air will be raised by the preheater 75 to 32° F. and the heat pump will operate between 32° F. and that inside the building rather than minus 50° F.

The preheater 75 requires a source of water in order to provide the water for heating the cold air flow. Each gallon of water supplies roughly one third of a kilowatt-hour of thermal energy. Thus, nine gallons of water will supply three kilowatt hours of heat.

It is to be noted that the tube 76 may be of a cylindrical cross-section or may be of any other suitable cross-section.

In order to prevent the water spray and snow from being carried by local rapid updrafts in the enclosure to the outlet duct 30, the air throughout the tube 76 flows upward at a more or less uniform rate. The space within the tube 76 must of course be protected from outside winds. In addition, the wire screen 81 across the top of the tube 76 will act as a "diffuser" and enhance the uniformity of the upflow velocity of the air. By control of the sizes of the nozzle orifices through which the water is sprayed, drop sizes are adjusted so that they are small enough to freeze before reaching the bottom of the tube 76 but large enough to sink at a speed relative to the surrounding air which is greater than the upflow velocity of the air. This dual objective can always be achieved by use of a tube 76 which is high enough to give drops time to freeze as they fall, and being enough to reduce the upflow velocity to a reasonably small value, e.g. 1 foot/sec. Thus, for an enclosure 8 feet high having a cross-section of 3.2 by 3.2 feet, the flow rate would be 10 cubic feet/ second and a drop of the spray, falling at 1.5 feet per second in still air and released in the tube 76 at a height of six feet, would have 12 seconds to fall before hitting the floor 82 of the preheater.

The speed "$\upsilon$" in meters/second is related to drop diameter "a" in meters by the well known stokes formula $\upsilon = mg/6\rho\eta a$ where "m" is the drop mass, "g" the gravitational constant and "$\eta$" the viscosity of air.

The floor 82 can be constructed so as to be moved or withdrawn sideways ever so often (e.g. every hour). The tube wall then acts to scrape off the snow 83 which then falls through a chute 82 to the outdoors. The resultant snow pile can be swept or shoveled away as need be or the snow from the chute can be distributed by a "snowblower" mechanism. Periodic warming of the inside walls of the tube 76 will release any frost which has formed thereon.

Should the expander 12 and compressor 11 use lubricated rings, oil fumes in the interspace between piston and cylinder walls can be bled off through the use of a "fume groove" (not shown) just above the rings. In this case, the piston wall is pierced with one or more pinholes, such that air in the interspace flows slowly downwards and exits to the crankcase. This requires that the average pressure of the air in the cylinder be greater than atmospheric.

The invention thus provides an engine which obtains energy by exchanging air between two air reservoirs at atmospheric pressure but different temperatures. The rate of mass flow of the air through the engine in both directions is the same. Upflow air (cold to hot) is first compressed with a reciprocating compressor then passed through a counterflow heat exchanger expander and discharged into the high temperature reservoir. Downflow air is passed through the heat exchanger without compression or expansion, and discharged into the cold reservoir. The work of expansion is used to drive the compressor and the surplus work to drive an external load. The cycle can be modified by first expanding downflow air which then passes through the heat exchanger, is then compressed and discharged into the cold reservoir, upflow air being passed through the heat exchanger without compression or expansion.

The invention also provides a heat pump in which downflow air is compressed, passed through the heat exchanger, expanded and discharged into the cold reservoir, while upflow air is passed through the heat exchanger without pressure change. Alternatively, upflow air can be expanded, then passed through the heat exchanger, then compressed, then discharged into the hot reservoir, while downflow air passes through the heat exchanger in the reverse direction without pressure change.

The invention also provides a snowmaker preheater whose output may be heated by means of a furnace or by heat derived from solar collectors. The snowmaker preheater may also operate in conjunction with a heat pump as described above or a conventional heat pump so that frost is not formed in the operation of the heat pump.

What is claimed is:

1. A dual open cycle engine comprising:

a cold air reservoir for storing air at a first temperature and pressure;

a hot air reservoir for storing air at a second temperature greater than said first temperature and at a pressure equal to said first pressure;

a positive displacement compressor connected to said cold air reservoir to receive and compress a flow of cold air therefrom;

a heat exchanger having a pair of countercurrent flow paths therein, one of said flow paths being connected to said compressor to receive a flow of compressed air therefrom and the other of said flow paths being connected to and between said reservoirs to conduct a flow of hot air from said hot air reservoir to said cold air reservoir in heat exchange relation with a flow of compressed air in said one path; and a positive displacement expander connected to and between said one path of said heat exchanger and said hot air reservoir to expand and deliver a flow of expanded air from said heat exchanger to said hot air reservoir.

2. A dual open cycle engine as set forth in claim 1 wherein said compressor and said expander are mounted on a common shaft.

3. A dual open cycle engine as set forth in claim 1 wherein said expander has a shaft for extracting work therefrom.

4. A dual open cycle heat pump comprising:

a cold air reservoir for storing air at a first temperature and pressure;

a hot air reservoir for storing air at a second temperature greater than said first temperature and at a pressure equal to said first pressure;

a heat exchanger having a pair of counter-current flow paths therein, one of said flow paths being connected between and to said reservoirs to conduct a flow of air from said cold air reservoir to said hot air reservoir;

a positive displacement compressor connected to and between said hot air reservoir and the other of said flow paths of said heat exchanger to compress and deliver a flow of hot air from said hot air reservoir to said other flow path; and a positive displacement expander connected between and to said other flow path of said heat exchanger and said cold air reservoir to expand and deliver a flow of expanded air from said heat exchanger to said cold air reservoir.

5. A dual open cycle heat pump as set forth in claim 4 which further includes a motor for driving said compressor and wherein said compressor and expander are mounted on a common shaft.

6. A dual open cycle engine comprising:

a cold air reservoir for storing air at a first temperature and pressure;

a hot air reservoir for storing air at a second temperature greater than said first temperature and at a pressure equal to said first pressure;

a positive displacement expander connected to said hot air reservoir to receive and expand a flow of hot air therefrom;

a heat exchanger having a pair of countercurrent flow paths therein, one of said flow paths being connected to said expander to receive a flow of expanded air therefrom and the other of said flow paths being connected to and between said reservoirs to conduct a flow of cold air from said cold air reservoir to said hot air reservoir in heat exchange relation with a flow of air in said one path; and a positive displacement compressor connected to and between said one path of said heat exchanger and said cold air reservoir to compress and deliver a flow of compressed air from said heat exchanger to said cold air reservoir.

7. A dual open cycle heat pump comprising:

a cold air reservoir for storing air at a first temperature and pressure;

a hot air reservoir for storing air at a second temperature greater than said first temperature and at a pressure equal to said first pressure;

a heat exchanger having a pair of countercurrent flow paths therein, one of said flow paths being connected between and to said reservoirs to conduct a flow of air from said hot air reservoir to said cold air reservoir;

a positive displacement expander connected to and between said cold air reservoir and the other of said flow paths of said heat exchanger to expand and deliver a flow of cold air from said cold air reservoir to said other flow path; and a positive displacement compressor connected between and to said other flow path of said heat exchanger and said hot air reservoir to compress and deliver a flow of compressed air from said heat exchanger to said hot air reservoir.

* * * * *

UNITED STATES PATENT AND TRADEMARK OFFICE

CERTIFICATE OF CORRECTION

PATENT NO. : 4,444,024

DATED : April 24, 1984

INVENTOR(S) : RICHARD MCFEE

It is certified that error appears in the above-identified patent and that said Letters Patent is hereby corrected as shown below:

Column 10, line 60, delete "22.3°F.r 12, .4°K. or"

Column 12, line 7, change "dondensation" to -- condensation--.

Signed and Sealed this

Sixth Day of November 1984

[SEAL]

*Attest:*

GERALD J. MOSSINGHOFF

*Attesting Officer*

*Commissioner of Patents and Trademarks*